United States Patent [19]

Alameda et al.

[11] Patent Number: 4,593,516

[45] Date of Patent: Jun. 10, 1986

[54] APPARATUS FOR FORMING TIGHT PACKAGES

[75] Inventors: Robert Alameda, 35 Hawthorne St., Salinas, Calif. 93901; Raymond Ash, Salinas, Calif.

[73] Assignees: Robert Alameda; Richard P. Cooper, both of Salinas, Calif.

[21] Appl. No.: 697,984

[22] Filed: Feb. 4, 1985

[51] Int. Cl.[4] ..... B65B 51/04; B65B 57/00

[52] U.S. Cl. ..... 53/75; 53/138 A; 53/583

[58] Field of Search ..... 53/64, 75, 76, 135, 53/138 A, 417, 419, 480, 481, 577, 583

[56] References Cited

U.S. PATENT DOCUMENTS

| | | | |
|---|---|---|---|
| 1,400,327 | 12/1921 | Sparks | 53/135 |
| 1,738,511 | 12/1929 | Anderson et al. . | |
| 2,513,459 | 7/1950 | Dodge | 53/577 X |
| 2,711,278 | 6/1955 | Gray . | |
| 2,718,991 | 9/1955 | Rabinowitz | 53/138 A |
| 2,884,749 | 5/1959 | Palmer et al. . | |
| 2,899,785 | 8/1959 | Gebhardt . | |
| 2,916,863 | 12/1959 | Leighton et al. . | |
| 3,553,924 | 1/1971 | Bonami | 53/76 X |
| 3,919,829 | 11/1975 | Burford et al. . | |
| 3,922,834 | 12/1975 | Clayton . | |
| 4,125,986 | 11/1978 | Sheetz . | |
| 4,291,517 | 9/1981 | Lipes . | |
| 4,328,654 | 5/1982 | Van Ginkel et al. | 53/138 A |
| 4,446,677 | 5/1984 | Kokido . | |

*Primary Examiner*—E. R. Kazenske
*Assistant Examiner*—Michael D. Folkerts
*Attorney, Agent, or Firm*—Manfred M. Warren; Robert B. Chickering; Glen R. Grunewald

[57] ABSTRACT

An automatic bag tying apparatus for converting an open bag loosely holding a substance into a tight package. A first gripping assembly tightly grips the unsealed bag toward its mouth. A second gripping assembly loosely and slidably grips the unsealed bag to form a neck. A displacement assembly displaces the gripping means relative to each other to cause the gripping means to move apart until the substance stops against the second gripping means. Bag closure applying apparatus then applies a closure to the bag in close proximity to the substance to create the final, closed, tight package. The tying apparatus further includes a guide assembly, and the gripping assemblies open sufficiently wide to allow passage of the bag and product therethrough which enables gravity loading of the apparatus. Tightening of the bag about the product is also controlled by pressure sensing apparatus to prevent over-tensioning of the bag.

14 Claims, 9 Drawing Figures

APPARATUS FOR FORMING TIGHT PACKAGES

BACKGROUND OF THE INVENTION

The field of this invention generally relates to packaging systems, and more particularly, relates to apparatus for forming a tight package from a bag having a product or substance disposed therein by tying or applying a closure to the bag in close proximity to the substance.

For marketing purposes, it has been found to be highly desirable to package products, and particularly produce, in a tight package. Consumer response to a product in a tight package is much more favorable than to the same quantity of product contained in a loose package.

Bag tying machines are well known in the art which include apparatus for forming a throat or neck in a bag proximate a product in the bag, and apparatus for applying a closure device, such as a wire, tape or clip, to the neck to secure the bag in a closed condition. Such bag tying apparatus often is not designed to provide for tightening of the bag around the product or depends upon an initial set-up and substantially uniform product size to achieve a tight bag. Typical of such prior art tying machines are the apparatus of U.S. Pat. Nos. 1,738,511, 2,711,278, 2,916,863, 3,919,829, 3,922,834 and 4,291,517.

Manually operable bag tying apparatus have been devised which will produce tight packages from bags having product therein. Such bag tying apparatus are formed to grip the bag near the end, form a throat or neck in the bag and pull the bag end until the neck is positioned immediately proximate the product, at which point a closure device is applied to the bag. Typical of manual bag tying apparatus which enable the formation of tight packages are the devices of U.S. Pat. Nos. 2,884,749 and 2,899,785.

Manual bag tying apparatus capable of forming tight packages, however, have been found to have several disadvantages which makes automation of the devices impractical. First, they often require tedious threading of the bag through a small opening. Additionally, securement of the bag to enable pulling of the neck down against the product also is tedious. Finally, such devices have relied upon the operator's touch and experience to establish how hard to pull on the bag.

Automation of bag tying apparatus which includes a tightening feature has met with limited success. U.S. Pat. No. 4,125,986 to Sheetz discloses a bagging apparatus with a weighing station, a bag loading station, a bag transfer station and a bag tying station. The amount of product to be packaged is determined by weight. The product is loaded into a bag which is gripped and suspended by fingers for transfer to a tying station. As the bag enters the tying station, the apparatus suspending the bag moves together to form a neck. The frame of the transfer station throws a switch, causing the tying machine to move downward a predetermined distance and then tie the bag.

The Sheetz apparatus is complex, and the apparatus for suspending and transferring the filled bag must be precisely adjusted. The tying operation occurs after the tying machine moves downward a predetermined distance toward the product within the bag; this distance must be adjusted by the operator in advance. Additionally, the Sheetz apparatus is not easy to retrofit into existing bagging systems.

U.S. Pat. No. 4,446,677 to Kokido discloses a packaging apparatus for producing a squeezed package. A predetermined amount of product is loaded into a bag. When the loading is completed, the weight of the product within the bag causes the product to narrow down to a throat above the product. This throat is positioned between a pair of fixed fingers; the throat is then further constricted by laterally closing a set of second fingers. Finally, the tying machine swings in from the side to apply a tie around the bunched throat.

The Kokido approach depends on an extremely complex arrangement of cams, gears and pushrods, requiring very precise tolerances in both manufacture and assembly. The relationship between the product in the bag and the tying machine is fixed; to obtain a tight package, the precisely correct quantity of product must be placed in the bag. Because the loading station and the tying station are integrated into one apparatus, the apparatus does not lend itself to being easily retrofitted into existing packaging assemblies. Also, the apparatus is not self adjusting during the tying process to accommodate product of varying size, for example, bundles of carrots of differing lengths.

SUMMARY OF THE INVENTION

This invention overcomes the shortcomings of previous approaches by providing a bag tying apparatus which automatically and easily produces tight packages of product every time.

The apparatus of the present invention includes a first gripping means formed for tightly and non-slidably grasping an open bag proximate the mouth of the bag. A second gripping means is provided which is formed for grasping the bag loosely and slidably to form a neck, when the second gripping means is in a fully closed position, at a position between the first gripping means and the product in the open bag. A displacement means is coupled to the first and second gripping means and formed to move the same with respect to each other until the second gripping means is positioned immediately proximate the product within the bag. With the second gripping means proximate the product, a closure applying means operates to apply a closure to the bag in close proximity to the product, to create the final, closed, tight package.

The improvement in the bag tying apparatus is comprised, briefly, of a bag guiding and support assembly formed for receipt of the bag and product from a bag loading apparatus and formed for gravity support of the bag and product in a position in which the upper end of the bag can be gripped by the gripping means. Support of the bag and product on the support portion automatically causes a plurality of opposed fingers comprising the gripping means to move to a closed position for tightly gripping the bag at the open end and forming a neck in the bag. After the gripping sequence, the gripping means are vertically displaced until a predetermined pressure between the bag with the product inside and the second gripping means is reached, at which point the bag is closed and then released to fall free of the apparatus under the influence of gravity. An anti-jamming structure is also provided and prohibits the apparatus from operating if any one of the first gripping means, or the second gripping means, or the displacement means is not fully closed or extended to operate as intended. If this happens, a bag will simply not be tied;

instead, the bag will drop free and can then be tied by hand.

DETAILED DESCRIPTION OF A PREFERRED EMBODIMENT

Figure 1:
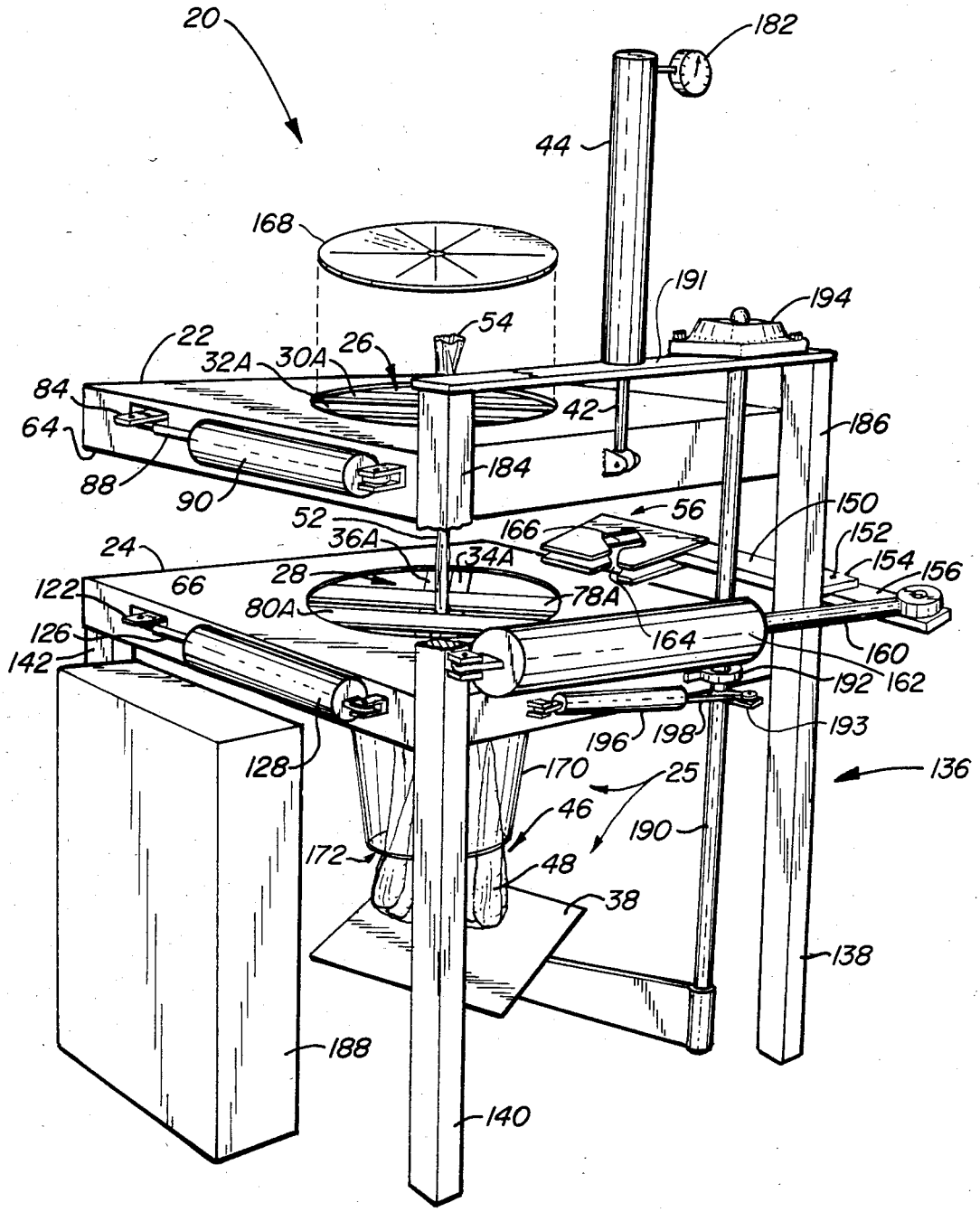
FIG. 1 is a perspective view of the rear of an apparatus constructed according to the present invention with the first and second gripping assemblies separated in preparation for tying a bag containing a substance.
Figure 3C:
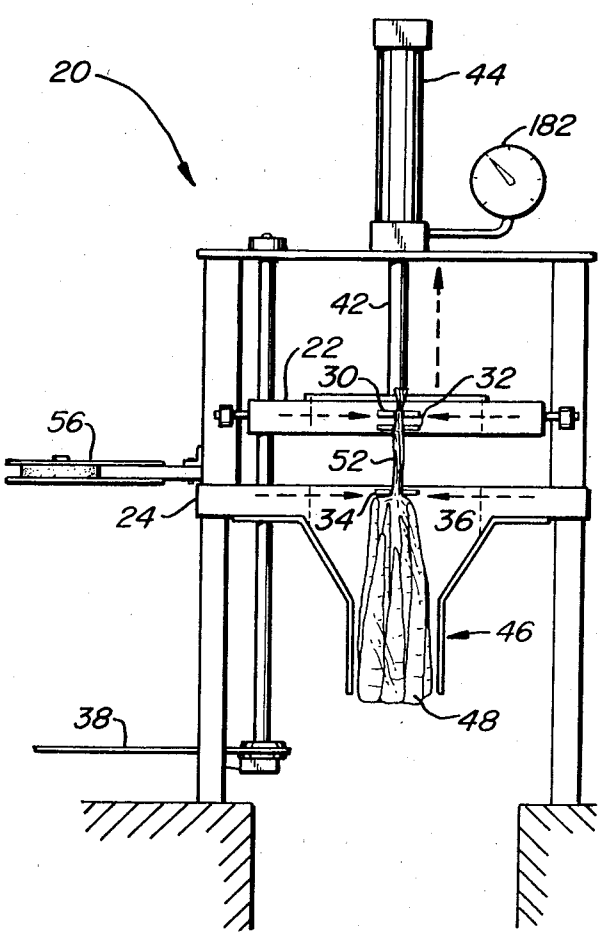
FIGS. 3A–3E show front elevation views of the apparatus of FIG. 1 as shown stepping through the process for forming a tight package according to the present invention.
Figure 3B:
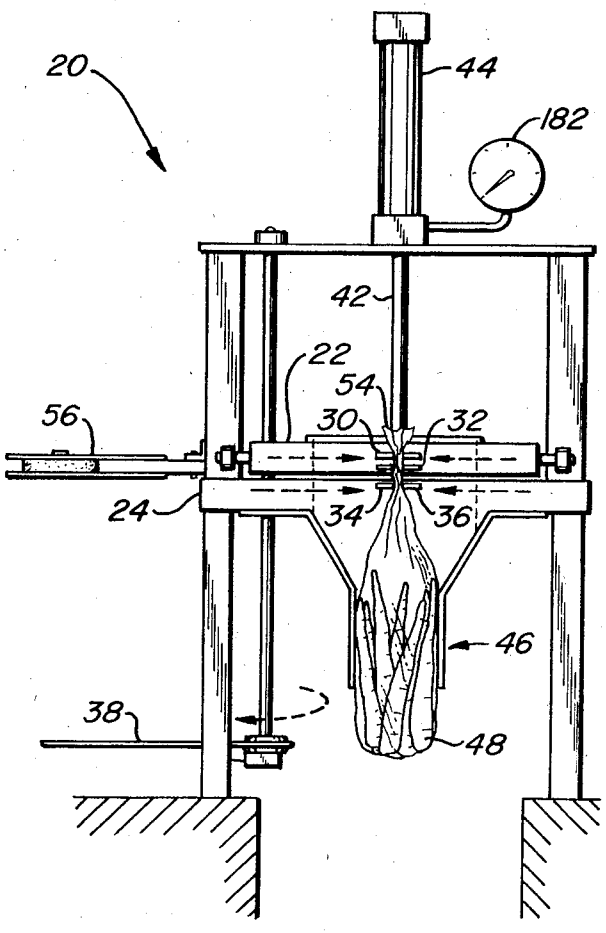
Figure 3A:
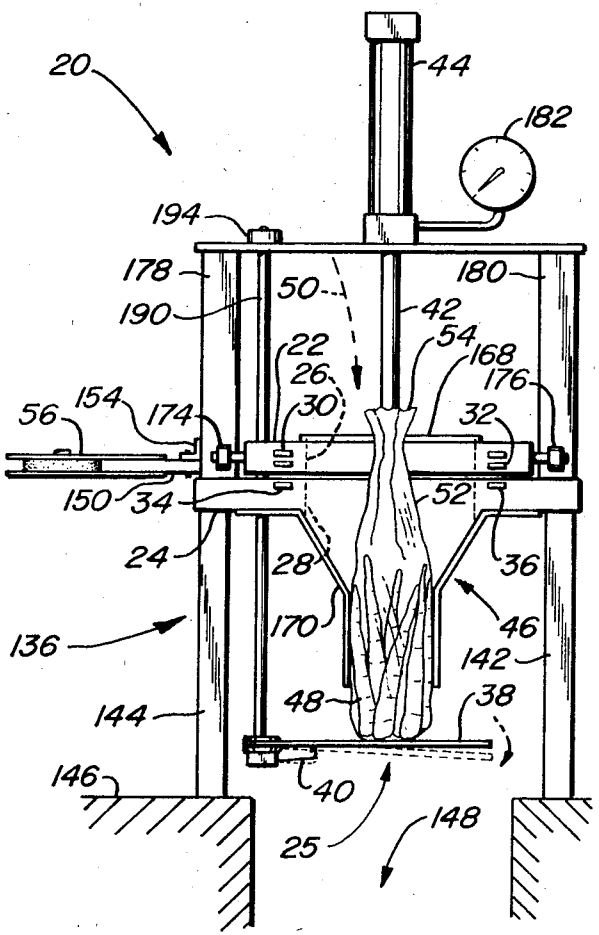

The basic elements of the automatic bag tying apparatus, generally designated 20, of the present invention can best be understood by reference to FIGS. 1 and 3A. Apparatus 20 is designed for use with bag loading apparatus, not shown, and includes a first gripping means or assembly 22 formed to tightly grip bag 46 proximate open end 54. Positioned below and proximate gripping assembly 22 is a second gripping assembly 24 which is formed to loosely grip the bag and form a neck portion 52 between end 54 and the product or substance 48 positioned in the bag.

In order to form a tight package, bag tying apparatus 20 also includes displacement means generally designated 44, which is coupled to one of the gripping assemblies 22 and 24, here through rod 42 to gripping assembly 22, and is formed to vertically displace gripping assembly 22 once bag end 54 has been gripped and a neck 52 formed in the bag. As gripping assembly 22 is vertically displaced, bag 46 is pulled through gripping assembly 24 until product 48 in the bag is urged against gripping assembly 24 to form a tight package.

The bag tying apparatus further includes a closure applying means or assembly 56 which is formed to apply a bag closure to neck 52 immediately above second gripping means 24 after displacement vertically to pull the bag tightly down over the product.

The elements of the bag tying apparatus of the present invention thus far described are broadly known in the prior art. In the improved apparatus 20, however, bag guiding and support means, generally designated 25, is provided which is formed to receive bag 46 with product 48 therein from a bag loading machine and guide the same to support plate 38 so that upper end 54 of bag 46 is positioned for gripping by the two gripping assemblies.

In order to permit easy and automated loading of bags into apparatus 20 without the need of tedious threading of bag ends into gripping mechanisms, gripping assemblies 22 and 24 are formed for movement between an open position (FIG. 3A), permitting movement as indicated by arrow 50 of the bag and product from a bag loading apparatus to support plate 38, and a closed position (FIG. 1) at which the bag is tightly gripped and necked-down by the respective gripping assemblies 22 and 24. Most preferably, gripping assemblies 22 and 24 include a plurality of fingers 30, 32, 34 and 36 that, in the open position, define axially aligned openings 26 and 28 dimensioned to receive bag 46 with product 48 therethrough. Openings 26 and 28 are further axially aligned with a funnel and depending sleeve structure 170 in guiding and support assembly 25. Thus, it is relatively simple to drop bag 46 through openings 26 and 28 and into funnel 170 which centers the bag in openings 26 and 28 for gripping by the gripping assemblies and assures support of the bag and substance on support plate 38.

Automatic actuation of gripping assemblies 22 and 24 occurs when the bag and product rest on plate 38 which is downwardly displaced and changes the state of switch 40 so as to power the gripping assemblies and cause movement of fingers 30, 32, 34 and 36 to the closed gripping position in a manner which will be more fully described hereinafter. Switch 40 also commences a timing cycle, which can be interrupted by a limit switch if various events are not completed, including vertical displacement of first gripping assembly 22 by displacement means 44.

Instead of attempting to pre-set a displacement distance, displacement means 44 includes pressure sensing means 182 which is formed to sense the pressure between gripping assembly 24 and substance 48 as the bag is necked down against the substance. When the pressure sensed by guage 182 reaches a predetermined known level, which can be adjusted in accordance with the bag material and thickness, further displacement of first gripping means 22 is terminated. Thus, variations in length of product 48 are automatically accounted for, and tying apparatus 20 will pull the bag end up until the resistance to further displacement presented by the substance inside the bag reaches a desired level.

Upon attainment of the pre-set pressure, closure assembly 56 also is automatically actuated. As shown in the drawing, assembly 56 is a tape applying device which swings from a retracted position, shown in FIGS. 1 and 3A, to a tape applying position, shown in FIGS. 3D and 3E. Such closure applying assemblies are well known in the art and can take the form of wire, clip or strand applying apparatus.

In operation, therefore, FIGS. 3A–3E show one cycle of forming a tight package using automatic bag tying apparatus 20. FIG. 3A shows that an initially unclosed or unsealed bag 46, loosely holding a substance 48, is dropped vertically as indicated by an arrow 50 from bag loading means (not shown) through openings 26 and 28. At this point, fingers 30, 32, 34 and 36 are positioned at the periphery of openings 26 and 28. Unsealed bag 46 hits pressure plate 38 while a bag neck 52 and an open bag mouth 54 are in the vicinity of the fingers. In response to bag impact, pressure plate 38 contacts and activates switch 40 to cause cycling of apparatus 20.

FIG. 3B shows that fingers 30 and 32 move together tightly to clamp the bag proximate mouth 54 with enough binding force to hold unsealed bag 46 suspended as pressure plate 38 pivots away to a retracted position. Simultaneously, fingers 34 and 36 move toward one another but do not come completely together; they instead stop short of contact to leave a gap between one another.

In FIG. 3C, upper assembly 22 moves vertically away from lower assembly 24 until substance 48 exerts a predetermined amount of pressure against lower fingers 34 and 36. When this predetermined pressure is reached, cylinder 44 stops moving upper assembly 22. The bag is now tightly stretched over product 48, and neck 52 extends down to just above the product.

Figure 3E:
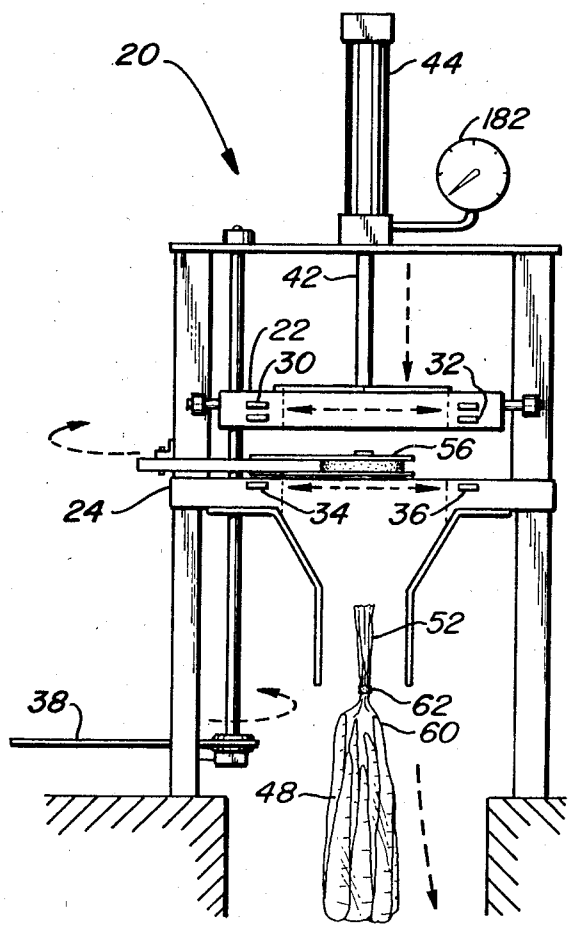
Figure 3D:
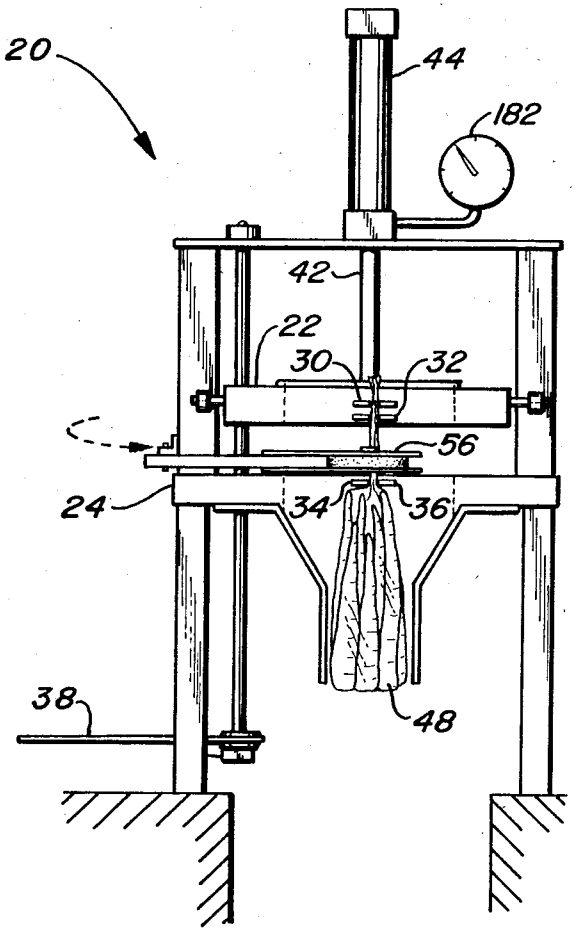

FIG. 3D shows that a pivotally mounted tying machine 56 swings in from the side to a position between assemblies 22 and 24, to wrap a tying device, such as a tape 62, a plastic clip or metal wire, around throat 52 immediately adjacent lower fingers 34 and 36. This has the effect of forming a tight package 60 because the tying machine seals throat 52 immediately adjacent substance 48 within the bag. Since the bag will most usually be formed of a resilient material, the tying of the bag above fingers 34 and 36 will be compensated by resilient contraction of the bag and vertical displacement of bag closure 62 toward substance 48. Selection of the pressure level at which displacement is terminated will be based in part on such resilient contraction after release of the tied bag.

In FIG. 3E, tight package 60 is released by moving apart upper fingers 30 and 32. Tight package 60 drops free under the influence of gravity. Lower fingers 34 and 36 may be moved apart at the time of opening of fingers 30 and 32 or thereafter to resume their starting positions, and tying machine 56 may also pivot away from assemblies 22 and 24 at the time of release of the upper fingers. After release of package 60, cylinder 44 lowers upper assembly 22 back down into contact with lower assembly 24, and pressure plate 38 pivots back into coaxial alignment with assemblies 22 and 24. With apparatus 20 back to the position shown in FIG. 3A, one cycle is complete and another cycle can be started.

Figure 2A:
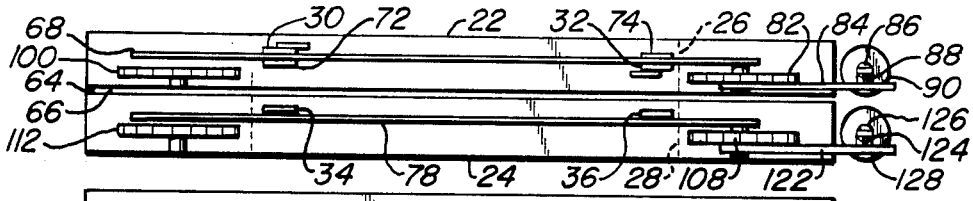
FIG. 2A is a front elevation view of the first and second gripping assemblies of the apparatus of FIG. 1 at the beginning of a tying sequence.
Figure 2B:
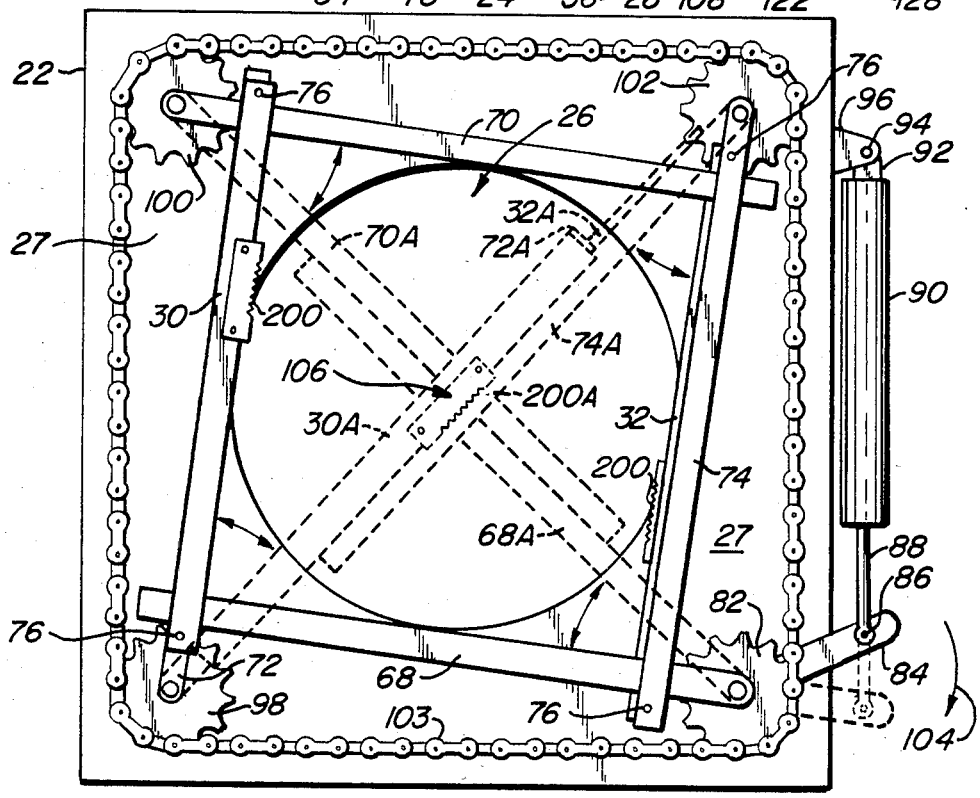
FIG. 2B is a top plan view of the first gripping assembly with the top cover removed and with the gripping finger shown in solid lines in the open positions and in broken lines in the closed position.
Figure 2C:
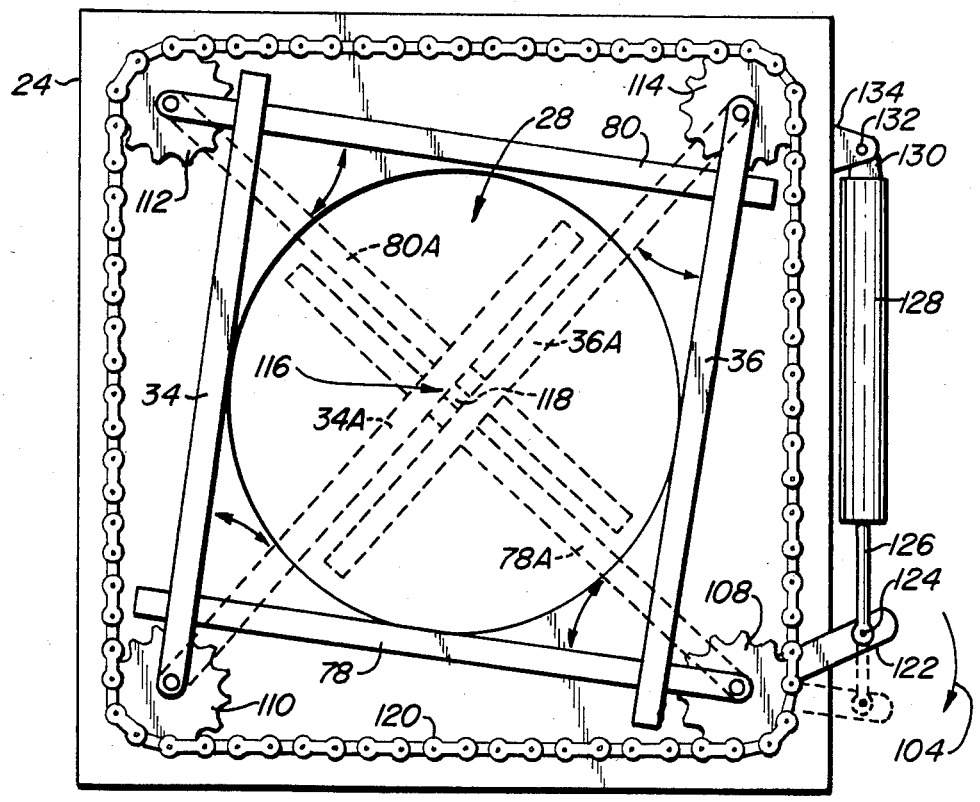
FIG. 2C is a top plan view corresponding to FIG. 2B of the second gripping assembly.

FIGS. 2A–2C show additional structural details of gripping assemblies 22 and 24. FIG. 2A shows schematically that which is shown with particularity in the top views of FIGS. 2B and 2C. The assemblies are in contact with one another along a respective upper face 64 and a lower face 66.

FIGS. 2A, 2B and 2C show elongated fingers 30 and 32 retracted to an open position proximate the periphery of opening 26 in assembly plate 27. In addition to this first pair of opposed fingers 30 and 32, assembly 22 preferably includes a second pair of opposed elongated fingers 68 and 70. Fingers 30 and 32 each carry a respective guide bar 72 and 74 attached in spaced apart relation to fingers 30 and 32 by bolts or screws 76, to create a space for receiving fingers 68 and 70. Guide bars 72 and 74 insure that the proper relation is maintained among all four fingers 30, 32, 68 and 70 during pivotal movement of the fingers. Finger 70 is not visible in FIG. 2A because it lies directly behind fingers 68 and is obscured by it. It also can be seen that lower assembly 24, in addition to a pair of opposed elongated fingers 34 and 36, has another second set of fingers 78 and 80.

In order to simultaneously move the fingers together for gripping of bag 46, the fingers are preferably mounted for pivotal movement to a plurality of sprockets. Thus, finger 68 is pivotally carried by a sprocket 82 mounted to turn within upper assembly 22. Sprocket 82 is driven by an arm 84 through pin 86 and piston shaft 88. It is preferable that the drive means for the gripping assemblies be pneumatic and that shaft 88 extend to a piston carried within a pneumatic upper cylinder 90 coupled to extend away from a side of the first gripping assembly 22.

Within upper assembly 22, the remainder of fingers 30, 70 and 76 are mounted in an identical fashion as finger 68 to sprockets. Thus, finger 30 is pivotally carried by a sprocket 98, finger 70 pivots about a sprocket 100, and finger 32 moves on a sprocket 102. To effect simultaneous pivoting operation of the fingers, a chain 103 mechanically connects sprockets 82, 98, 100 and 102.

Fingers 2B and 2C show with solid lines the fingers 68, 30, 70 and 32 at their open position adjacent the sides of upper assembly 22 and the periphery of opening 26. The broken lines show the respective fingers when in the fully closed position, as designated by fingers 68A, 30A, 70A and 32A. By energizing cylinder 90, shaft 88 moves in the direction indicated by an arrow 104, causing arm 84 to move in the same direction away from cylinder 90. Arm 84 pivots sprocket 82 causing finger 68 to pivot inward to assume the position indicated by dashed finger 68A. By pivoting, sprocket 82 moves chain 102, which in turn pivots sprockets 98, 100 and 102 to cause the remaining fingers to pivot inwardly across opening 26 to assume the position indicated by fingers 30A, 70A and 32A. When in the fully closed position, fingers 68, 30, 70 and 32 engage and overlap one another in a contact region 106.

The construction of fingers 78, 34, 80 and 36 within second gripping assembly 24 is substantially identical to that of the fingers within first gripping assembly 22; therefore, lower assembly 24 is described in a somewhat abbreviated fashion. Fingers 78, 34, 80 and 36 are carried to pivot on respective sprockets 108, 110, 112 and 114. When pivoted to a fully closed position at a contact region 116, the fingers assume the orientations shown in phantom as fingers 78A, 34A, 80A and 36A. At the fully closed position within contact region 116, the fingers leave a gap 118 dimensioned to loosely confine, but not tightly grip, bag 46.

The second set of sprockets are mechanically coupled together by chain 120, and sprocket 108 is connected by arm 122 piston shaft 126 which extends from pneumatic cylinder 128. When cylinder 128 is energized, the combined movement of shaft 126, arm 122, sprockets 108, 110, 112, 114 and chain 120 causes resting arms 78, 34, 24 and 36 to pivot and move across opening 28, to assume the fully closed position indicated by phantom lines as fingers 78A, 34A, 80A and 36A.

Referring now to FIG. 1, it will be seen that apparatus 20 includes a frame 136 for supporting the various parts when assembled. Frame 136 includes a group of legs 138, 140, 142 and 144. FIGS. 3A–3E show frame 136 supported on a floor 146 suspended above an opening 148 in floor 146. Opening 148 indicates schematically that tight package 60 is provided enough room beneath frame 136 to drop free under the influence of gravity for transport away from apparatus 20.

Tying machine 56 is carried by an arm 150 pivotally connected with a pin 152 which is coupled to a flange 154 extending from frame leg 138. A portion 156 of arm 150 extends beyond flange 154 and is pivotally coupled to piston rod 160 extending outwardly from pneumatic cylinder 162. This cylinder, as with all the other pneumatic cylinders used with package forming apparatus 20, is coupled by conventional means to a compressed air source (not shown), and its operation is sequenced by controller 188 using conventional pneumatic logic circuitry. Tying machine 56 in this preferred embodiment is a conventional machine having a slot 164 through which neck 52 slides en route to a central opening 166 where a strip of tape 150 (FIG. 3A) is securely wrapped around neck 52 to close bag 46.

Two structures are provided on apparatus 20 for guiding unsealed bag 46, now holding substance 48, as it enters bag tying apparatus 20. Upper opening 26 of first gripping assembly 22 preferably carries a flexible disk-like guide 168, formed by cutting lines radially from the center of a flexible material, such as plastic or rubber, out toward the circumference of the material. Because the resulting pie shaped sections of guide 168 are not joined at their center, but are continuously joined at their circumference, guide 168 can be fitted into upper opening 126 without impeding the downward passage of bag 46. Guide 168 has the effect of centering and loosely gathering bag 46 to create the somewhat restricted neck 52 to improve the handling characteristics of the bag.

Mounted in lower assembly 24 is a conically shaped chute 170 having a wide mouth positioned adjacent lower opening 28, and tapering inwardly toward a narrower mouth 172 which stops above pressure plate 38. Chute 170 centers bag 46 as it passes through upper opening 26 and lower opening 28.

FIGS. 3A–3E schematically show that lower assembly 24 is immovably secured within frame 136. However, upper assembly 22 is free to move vertically up and down within frame 136, as indicated schematically by a pair of wheels 174 and 176 mounted to roll on guides 178 and 180. In fact, wheels 174 and 176 are not exposed as shown in FIG. 3A. Instead, they are carried within respective extension portions 184 and 186 of legs 140 and 138. As previously mentioned, upper assembly 22 is coupled by rod 42 to be carried by a piston (not visible) carried within pneumatic cylinder 44.

Support plate 38 is securely coupled to a shaft 190. This shaft is pivotally mounted within a collar 192 secured to lower assembly 24 and a collar 194 attached to upper frame member 191. In order to enable retraction of plate 38 for gravitation of bags from the tying apparatus, pneumatic cylinder 196 is provided which has a piston rod 198 coupled to a lever arm 193 extending from shaft 190. Pneumatic cylinder 196 can pull rod 198 back and forth, causing shaft 190 to pivot, and therefore pressure plate 38 to pivot into and out of alignment beneath openings 26 and 28 and guide funnel 170.

FIGS. 1 and 3A–3E can be used in describing the details of operation which were broadly covered above. Initially, upper assembly 22 and lower assembly 24 are in contact with each other as shown in FIG. 3A. All fingers are in the initially open position shown in FIGS. 2A, 2B and 2C, withdrawn against the sides of assemblies 22 and 24 and positioned at the periphery of openings 26 and 28.

An unclosed bag 46 is dropped through or otherwise introduced from a bag loading apparatus or by hand into guide 168 mounted in opening 26. Unsealed bag 46 continues its downward journey to encounter chute 170 to be generally centered within openings 26 and 28 at the time of impact with pressure plate 38.

When hit by bag 46, plate 38 moves downward slightly, as shown in FIG. 3A, to strike switch 40; this begins the cycle for forming a closed tight package. The sets of fingers carried in assemblies 22 and 24 move into openings 26 and 28. At their fully closed position, the first pair of opposed fingers 30 and 32 slightly overlap to firmly grip that portion of bag neck 52 residing within contact region 106 shown in FIG. 2B. At least one and preferably several of teeth or serrations 200 are carried on the biting edge of the fingers to improve the grip exerted on the upper end of the bag.

Likewise, cylinder 128 moves the sprockets and chain of lower assembly 24 to move fingers 70, 34, 80 and 36 into contact region 116 shown in FIG. 2C. The fingers in the lower assembly, however, do not come into contact with one another in their fully closed position. Instead, they are separated by gap 118 having a small square cross-sectional area. Gap 118 exists so that portion of neck 52 within gap 118 remains gathered but can slip with respect to the second gripping assembly.

As shown in FIG. 3B, pressure plate 38 pivots away from apparatus 20 to leave unsealed bag 46 suspended by the pinching action of the fingers in the first bag gripping assembly. As shown in FIG. 3C, cylinder 44 pulls assembly 22 upward vertically away from lower assembly 24, moving unsealed bag 46 and substance 48 with it. Substance 48 encounters the fingers within lower assembly 24 and resists further upward movement of assembly 22. This resistance causes a building of pressure within cylinder 44. When a predetermined and pre-set pressure maximum has been reached, guage 182 senses this and stops further upward displacement of gripping assembly 22.

As shown in FIG. 3C, substance 48 now presses firmly against the lower fingers 34 and 36, neck 52 is pulled taut, and the upper and lower assemblies 22 and 24 are separated from one another. If at this point in the cycle any of the fingers have not assumed their fully closed position, or assemblies 22 and 24 have not separated to be fully extended as desired, the tying procedure is interrupted. Limit switches (not visible) carried within assemblies 22 and 24 are thrown as the fingers move, and as the upper and lower assemblies separate at least to a minimum amount. If the limit switches are not thrown, the bag tying procedure is interrupted, the fingers open, and untied bag 46 drops downward and free of apparatus 20. This anti-jamming feature stops tying machine 56 from tying the bag when it is not properly gripped and distended. In the event of interrupted operation, the bag drops free and may be tied by hand.

If everything has gone as intended at this point, tying machine 56 is pivoted by cylinder 162 and rod 60 to swing into the tying position shown in FIG. 3D, where it ties the bag immediately above and adjacent fingers 34 and 36. Because fingers 34 and 36 rest against substance 48, the bag is tied as close to substance 48 as possible. While tying machine 56 is still centered between openings 26 and 28, the fingers separate and the now tight package 60 drops. All the equipment returns to the starting position shown in FIG. 3A, with tying machine 56 off to the side, pressure plate 38 beneath assemblies 22 and 24, and assemblies 22 and 24 in contact with one another with all fingers retracted from openings 26 and 28. A new tying cycle can now proceed.

What is claimed is:

1. An automatic bay tying apparatus formed to produce a tight package from a bag loosely containing a substance therein, the apparatus including first gripping means formed to tightly grip the bag proximate an open end thereof, second gripping means formed to slidably engage the bag intermediate the first gripping means and the substance and formed to constrict the bag to form a neck, displacement means formed and coupled to produce relative displacement between the first gripping means and the second gripping means to cause sliding of the bag with respect to the second gripping means until the neck is positioned immediately proximate the substance, and closure applying means formed to apply a bag closure to the bag closely proximate the neck, wherein the improvement in the bag typing apparatus comprises:

bag guiding and support means formed to receive the bag and substance from a bag loading apparatus and formed to support the bag and substance in a position for gripping by the first and second gripping means;

the first and second gripping means each including means mounting said gripping means for movement between an open position permitting movement of the bag and product from the bag loading apparatus to the bag guiding and support means and the closed position gripping the bag;

means for automatically actuating the first gripping means and the second gripping means to cause movement from the open position to the closed position when the bag and substance are supported on the bag guiding and support means; and the displacement means further having pressure sensing means formed to terminate relative displacement of the gripping means upon sensing of a predetermined pressure between the second gripping means and the bag and substance and formed to actuate the closure applying means to apply a bag closure upon sensing of the predetermined pressure.

2. An automatic bag tying apparatus as defined in claim 1, wherein:

the first gripping means and the second gripping means each includes assemblies of movable fingers which are mounted for movement between the open position at which the fingers are positioned proximate the periphery of the bag guiding and support means and the closed position at which the fingers grip the bag.

3. An automatic bag tying apparatus as defined in claim 2, wherein:

the bag guiding and support means is formed for gravity guiding and positioning of the bag and substance on a support surface.

4. The automatic bag tying apparatus as defined in claim 2, wherein the first gripping means comprises:

a first pair of opposed fingers movably mounted to close together into a closed position in which the first pair of fingers are in slightly overlapping relation to grip the bag therebetween; and a second pair of opposed fingers movably mounted to close together into the closed position to grip the bag therebetween, the second pair of fingers further being positioned adjacent the first pair of fingers and aligned when in the closed position to be oriented tranversely with respect to the first pair of fingers.

5. The automatic bag tying apparatus as defined in claim 4, wherein:

opposed serrated portions are provided on the first pair of fingers at the region of overlapping relation, and the second pair of fingers is oriented substantially at right angles with respect to the first pair of fingers.

6. The automatic bag tying apparatus as defined in claim 4, further including:

guide means carried by one of the first pair of fingers and the second pair of fingers and formed for guided movement of the first pair of fingers and the second pair of fingers between the open position and the closed position.

7. The automatic bag tying apparatus as defined in claim 6, wherein:

the guide means is provided by a pair of guide bars mounted to one of the first pair of fingers and the second pair of fingers in spaced relation thereto with a remainder of the first pair of fingers and the second pair of fingers positioned in sliding engagement between the guide bar and the finger on which the guide bar is mounted.

8. The automatic bag tying apparatus as defined in claim 4, wherein the second gripping means comprises:

a first pair of opposed fingers movably mounted to close toward each other and stop in the closed position with the first pair of fingers in spaced apart relation to define a first gap therebetween dimensioned to slidably receive the bag; and a second pair of opposed fingers movably mounted to close toward each other and stop in the closed position with the lower pair of fingers in spaced apart relation to define a second gap therebetween dimensioned to slidably receive the bag, the first pair of fingers being positioned below and adjacent the second pair of fingers and being aligned in the closed position transversely with respect to the first pair of fingers so the first and second gaps between the fingers are substantially coaxially aligned.

9. The automatic bag tying apparatus as defined in claim 2, wherein:

the movable fingers are provided as pairs of pivotally mounted elongated fingers formed to define an opening therebetween in the open position dimensioned for passage of the bag and substance therethrough and mounted for pivotal movement toward each other into engagement of the bag with longitudinally extending sides of the fingers.

10. The automatic bag tying apparatus as defined in claim 9, wherein:

the first gripping means and the second gripping means each include pneumatic actuating means coupled by linkage means to pivot the fingers and coupled to the means for automatically actuating the gripping means.

11. The automatic bag tying apparatus as defined in claim 9, wherein:

the fingers are mounted to a plurality of sprockets and the sprockets are coupled together for simultaneous movement by a chain to effect pivotal movement; and actuating means coupled to drive at least one of the sprockets and the chain.

12. The automatic bag tying apparatus as defined in claim 1, wherein:

the bag guiding and support means includes a support plate mounted for movement between a retracted position and a bag supporting position; and the means for automatically actuating the first gripping means and the second gripping means includes a switch mounted for closure upon supporting of the bag and substance on the support plate.

13. The automatic bag tying apparatus as defined in claim 2, wherein:

the movable fingers of the first gripping means and the second gripping means are provided as pairs of opposed fingers defining axially vertically aligned openings therebetween in the open position dimensioned to receive the bag and substance for gravity loading of the bag and substance therethrough;

the bag guiding and support means includes a vertically extending channel defining mean dimensioned to receive the bag and substance therein and to axially align the bag with the openings in the first gripping means and the second gripping means, a support plate mounted for movement between a retracted position not aligned with the openings and a bag supporting position extending across the channel, and means coupled to drive the support plate between the retracted position and the bag supporting position; and means formed for automatically moving the support plate to the retracted position after gripping by the first gripping means and for releasing the first gripping means and the second gripping means after applying the bag closure to the bag to permit gravity displacement of the tied bag from the apparatus.

14. The apparatus as defined in claim 1 wherein:

the first gripping means is mounted above the second gripping means and is mounted for displacement by the displacement means in an upward direction after tightly grasping the bag to carry the bag upwardly with it while the second gripping means is mounted to remain stationary after loosely grasping the bag.

* * * * *